US010350472B2

(12) United States Patent
Golden et al.

(10) Patent No.: US 10,350,472 B2
(45) **Date of Patent: *Jul. 16, 2019**

(54) SYSTEM AND METHOD FOR WEIGHTING A GOLF CLUB

(71) Applicant: Acushnet Company, Fairhaven, MA (US)

(72) Inventors: Charles E. Golden, Encinitas, CA (US); Noah de la Cruz, San Diego, CA (US); Daniel Stone, Long Beach, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/980,607

(22) Filed: May 15, 2018

(65) Prior Publication Data

US 2018/0256953 A1 Sep. 13, 2018

Related U.S. Application Data

(62) Division of application No. 14/982,730, filed on Dec. 29, 2015, now Pat. No. 10,046,217.

(51) Int. Cl.

| | |
|---|---|
| ***A63B 60/24*** | (2015.01) |
| ***A63B 53/14*** | (2015.01) |
| ***A63B 60/16*** | (2015.01) |
| *A63B 60/04* | (2015.01) |
| *A63B 60/02* | (2015.01) |
| *A63B 53/08* | (2015.01) |
| *A63B 53/10* | (2015.01) |
| *A63B 53/12* | (2015.01) |
| *A63B 53/04* | (2015.01) |

(52) U.S. Cl.

CPC ..... *A63B 60/24* (2015.10); *A63B 53/14* (2013.01); *A63B 60/16* (2015.10); *A63B 53/08* (2013.01); *A63B 53/10* (2013.01); *A63B 53/12* (2013.01); *A63B 60/02* (2015.10); *A63B 60/04* (2015.10); *A63B 2053/0491* (2013.01)

(58) Field of Classification Search

CPC ..... A63B 53/145; A63B 60/02; A63B 60/04; A63B 60/16; A63B 53/08; A63B 53/10; A63B 53/12; A63B 53/14; A63B 2053/0491

USPC ..... 473/297, 292, 291, 334, 335, 338, 339

See application file for complete search history.

(56) References Cited

U.S. PATENT DOCUMENTS

| | | | |
|---|---|---|---|
| 1,167,106 | A | 1/1916 | Palmer |
| 1,167,387 | A | 1/1916 | Daniel |

(Continued)

FOREIGN PATENT DOCUMENTS

| | | |
|---|---|---|
| GB | 194823 | 3/1923 |
| JP | 2006187489 | 7/2006 |

(Continued)

OTHER PUBLICATIONS

US. Appl. No. 16/132,053, filed Sep. 14, 2018, Luttrell et al.

*Primary Examiner* — Benjamin Layno
(74) *Attorney, Agent, or Firm* — Randy K. Chang

(57) ABSTRACT

A system and method for weighting a golf club. The system is configured to adjust the overall club weight and the weight balance of a golf club. The system includes a weight assembly formed with a plurality of flexible cantilevered arms that interact with a weight member.

20 Claims, 11 Drawing Sheets

(56) References Cited

U.S. PATENT DOCUMENTS

| | | | | |
|---|---|---|---|---|
| 2,517,245 | A | 8/1950 | Scott | |
| 3,075,768 | A | 1/1963 | Karns | |
| 3,606,327 | A | 9/1971 | Gorman | |
| 6,379,265 | B1 | 4/2002 | Hirakawa et al. | |
| 6,773,360 | B2 | 8/2004 | Willett et al. | |
| 7,294,065 | B2 | 11/2007 | Liang et al. | |
| 7,699,718 | B2 * | 4/2010 | Lindner | A63B 53/00 473/297 |
| 7,704,161 | B2 | 4/2010 | Lindner | |
| 7,717,804 | B2 | 5/2010 | Beach et al. | |
| 8,177,658 | B1 | 5/2012 | Johnson | |
| 8,292,757 | B2 | 10/2012 | Soracco | |
| 8,388,465 | B2 | 3/2013 | de la Cruz et al. | |
| 8,540,589 | B2 | 9/2013 | Bezilla et al. | |
| 8,684,863 | B2 | 4/2014 | Bezilla et al. | |
| 9,089,748 | B2 | 7/2015 | Morales et al. | |
| 9,421,421 | B2 | 8/2016 | Knutson et al. | |
| 9,421,432 | B2 | 8/2016 | Galvan et al. | |
| 9,504,884 | B2 | 11/2016 | Bennett et al. | |
| 9,700,767 | B2 | 7/2017 | Zimmerman et al. | |
| 9,700,770 | B2 | 7/2017 | Cleghorn et al. | |
| 9,707,458 | B2 | 7/2017 | Luttrell et al. | |
| 9,731,173 | B2 | 8/2017 | Bezilla et al. | |
| 9,737,770 | B2 | 8/2017 | Bennett et al. | |
| 9,744,415 | B2 | 8/2017 | Frame et al. | |
| 9,827,470 | B2 | 11/2017 | Knutson et al. | |
| 9,937,397 | B2 | 4/2018 | Barksdale et al. | |
| 10,046,217 | B2 * | 8/2018 | Golden | A63B 60/24 |
| 2005/0079925 | A1 | 4/2005 | Cheng et al. | |
| 2010/0105498 | A1 | 4/2010 | Johnson | |
| 2013/0165249 | A1 * | 6/2013 | Margoles | A63B 53/14 473/297 |
| 2015/0360101 | A1 * | 12/2015 | Solhaug | A63B 53/10 473/297 |
| 2017/0282029 | A1 | 10/2017 | Cleghorn et al. | |
| 2017/0312600 | A1 | 11/2017 | Luttrell et al. | |

FOREIGN PATENT DOCUMENTS

| | | |
|---|---|---|
| JP | 2006198251 | 8/2006 |
| JP | 2006239154 | 9/2006 |

* cited by examiner

SYSTEM AND METHOD FOR WEIGHTING A GOLF CLUB

CROSS-REFERENCE TO RELATED APPLICATIONS

This application is a divisional of U.S. patent application Ser. No. 14/982,730, filed Dec. 29, 2015, now U.S. Pat. No. 10,046,217 the disclosure of which is incorporated herein by reference in its entirety.

FIELD OF THE INVENTION

This invention generally relates to golf club heads, and more specifically to golf club heads including adjustable overall weighting.

BACKGROUND OF THE INVENTION

Weights have been incorporated into golf clubs to distribute discretionary mass in order to alter the mass characteristics. For example, weights may be incorporated to provide adjustability in characteristics such as swing weight, location of the center of gravity and manipulation of the moment of inertia of a particular golf club head. Various weight designs have been utilized that allow the manufacturer and/or consumer to alter the mass properties of a golf club head.

One example of a weight incorporated into a club head is described in U.S. Pat. No. 1,167,106 to Palmer for a Golf Club. Palmer describes a golf club that includes a threaded opening that receives threaded weight plugs for varying the weight of a cast metal golf club head. The threaded opening extends through a rear wall of the golf club head and receives a threaded plug which may be just long enough to fill the opening or it may extend further into the golf club head to increase the weight. The threaded opening is tapered so that the plug may be tightened to a desired depth. A disadvantage of the threaded weight plug is that it is constructed as a single piece. As a result, torque applied to the weight plug during use of the golf club is transmitted to the threaded portion and may result in the weight plug becoming disengaged, especially with repeated use.

In another example, described in U.S. Pat. No. 1,167,387 to Daniel, a weight socket is attached to a golf club head and to the end of a golf club shaft. Weights are installed into the socket and a screw on cap is installed on the end of the socket to secure the weights inside.

In another example, described in U.S. Pat. No. 3,075,768, a compartment is incorporated into a proximal end of the golf club adjacent a grip. The compartment holds weighting means so that the balance of the golf club can be altered after the golf club is assembled.

In yet another example, described in U.S. Pat. No. 3,606,327, a capsule is secured to a grip end of a golf club shaft and to a golf club head. Washers having different weights are inserted into each capsule and held in place by a screw. The screw extends through the centers of the washers and is threaded into an aperture at the bottom of the capsule.

Another example of a removable weight is described in U.S. Pat. No. 6,773,360 to Willett et al. for a Golf Club Having a Removable Weight. The removable weight includes a mass element and a fastener that extends through an aperture in the mass element. A golf club head body includes an interior cavity and a recess on a wall of the body. Inside the recess, a threaded opening is provided so that the fastener may extend through the mass element disposed in the recess and into the threaded opening to fasten the mass element in the recess. Because the fastener extends through the mass element and into a threaded opening in the recess, the size of the mass element and the structure of the recess are limited. Additionally, the mass element is visible to the user when installed so less variation is available for the mass element without detrimentally affecting the aesthetics of the club head.

These weight constructions have been used to alter the static mass properties of the golf club. It is desirable to provide a system for weighting a golf club golf club and a method for incorporating that system to alter the dynamic characteristics of a golf club during a swing.

SUMMARY OF THE INVENTION

The invention is directed to a golf club head and a removable weight. Several embodiments of the present invention are described below.

In an embodiment, a weight assembly for attachment to a golf club comprises a housing, and a weight member. The housing includes a base, a plurality of flexible cantilevered arms extending distally away from the base, and a threaded portion. The weight member includes a shank that is threaded, and the shank is threaded into the threaded portion of the housing.

In another embodiment, a weight assembly for attachment to a golf club comprises a housing, a weight member, and an actuator. The housing includes a base and a plurality of flexible cantilevered arms extending distally away from the base. The weight member is disposed in the housing, and has a first position relative to the housing and a second position relative to the housing. The actuator is interposed between a portion of the housing and a portion of the weight member, and is movably coupled to the housing and movably coupled to the weight member. In the first position the flexible arms are in a retracted configuration, and in second position the flexible arms are in an expanded configuration wherein a maximum outer dimension of the flexible arms is greater in the expanded configuration than in the retracted configuration.

In another embodiment, a weight assembly for attachment to a golf club comprises a housing, and a weight member. The housing includes a base and a plurality of flexible cantilevered arms extending distally away from the base. The base defines a cavity and each of the flexible arms includes a barb disposed at a distal end that extends outward from an adjacent portion of the flexible arm. The weight member is disposed in the cavity.

In another embodiment, a golf club comprises a golf club head, a shaft, a grip and a weight member. The golf club head includes a ball striking face and a hosel. The shaft includes an elongate body having a proximal end and a distal end, and the distal end is coupled to the hosel. The grip includes a recess extending into the grip from an outer surface of the grip and is coupled to the proximal end of the elongate body. The recess is open outwardly. The weight member is disposed in the recess, and the weight member has a shape that complements the shape of the recess.

BRIEF DESCRIPTION OF THE DRAWINGS

In the accompanying drawings, which form a part of the specification and are to be read in conjunction therewith and in which like reference numerals are used to indicate like parts in the various views.

DETAILED DESCRIPTION OF THE PREFERRED EMBODIMENTS

Figure 1:
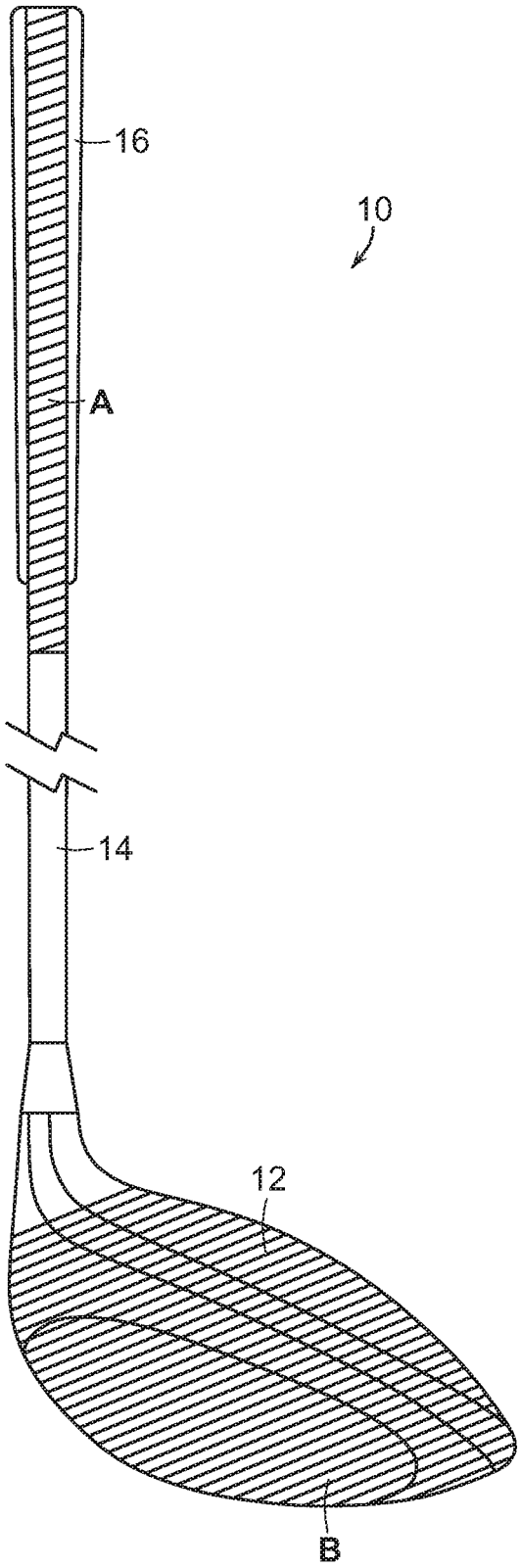
FIG. 1 is a front view of a golf club including an adjustable overall weight system in accordance with the present invention.

The present invention is directed to a weight system for a golf club. The removable weight is provided for use with a golf club to alter the mass properties of the golf club. Several embodiments of the present invention are described below.

Other than in the operating examples, or unless otherwise expressly specified, all of the numerical ranges, amounts, values and percentages such as those for amounts of materials, moments of inertias, center of gravity locations, loft and draft angles, and others in the following portion of the specification may be read as if prefaced by the word "about" even though the term "about" may not expressly appear with the value, amount, or range. Accordingly, unless indicated to the contrary, the numerical parameters set forth in the following specification and attached claims are approximations that may vary depending upon the desired properties sought to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard deviation found in their respective testing measurements. Furthermore, when numerical ranges of varying scope are set forth herein, it is contemplated that any combination of these values inclusive of the recited values may be used.

The system and method of the present invention utilize weights in a golf club to adjust the overall club weight. Preferably, the system is constructed so that the overall club weight can be altered without changing properties like the swing weight, the shaft flex, the shaft kick point, the location of the center-of-gravity (CG) of the golf club or golf club head, or the coefficient of restitution (COR) of the golf club head.

Players react to overall club mass in different ways. Some people find that they swing a lighter golf club faster. Other players find that they swing a heavier golf club faster. The faster golf swing generally results in a greater outgoing ball speed which translates into greater distance. Additionally, the overall mass of the golf club may be used to alter the swing tempo of a player, which can alter the club head speed and/or orientation at impact and can improve the feel of impact.

Players also generally find that particular shafts provide bending and twisting profiles during a golf swing that provides desired performance during a golf swing. For example, players will often find that a shaft that matches their swing allows better accuracy or desired launch angle and/or backspin. However, the mass of the shaft is not always desired because it may add too much or too little to the overall mass of the golf club, or it may have a center of gravity that detrimentally affects the balance of the golf club.

Referring to FIG. 1, the system of the present invention includes a golf club 10 that includes a head 12, a shaft 14 and a grip 16. The head 12 is included in a head portion of golf club 10, and the grip 16 is included in a grip portion of golf club 10. The golf club is constructed to selectively receive removable weights in both the head portion and the grip portion as shown by the cross-hatched portions A, B of FIG. 1. In particular, the golf club head includes a replaceable weight, preferably near a sole or toward an aft portion of a skirt of the club head. The shaft also includes a replaceable weight that locates weight generally at a proximal end of the golf club, and preferably within 16 inches of the butt end of the shaft. Preferably, the weights are heavy enough to alter the overall mass of the golf club by up to +/−60 grams. The weights are preferably incremented so that the overall club mass may be changed in increments of 20 grams, and more preferably in increments of 10 grams.

The system of the present invention may also be used to create a training system. For example a golf club is fit to a user having a mass. Weights are selected to be added to the golf club to increase the overall mass by about 15% to form a heavy club. Additional weight combinations are determined to decrease the golf club by about 15% to form a light club. The player may then practice with the golf club in the three configurations to increase swing strength and to manipulate the tempo of their swing.

Figure 3:
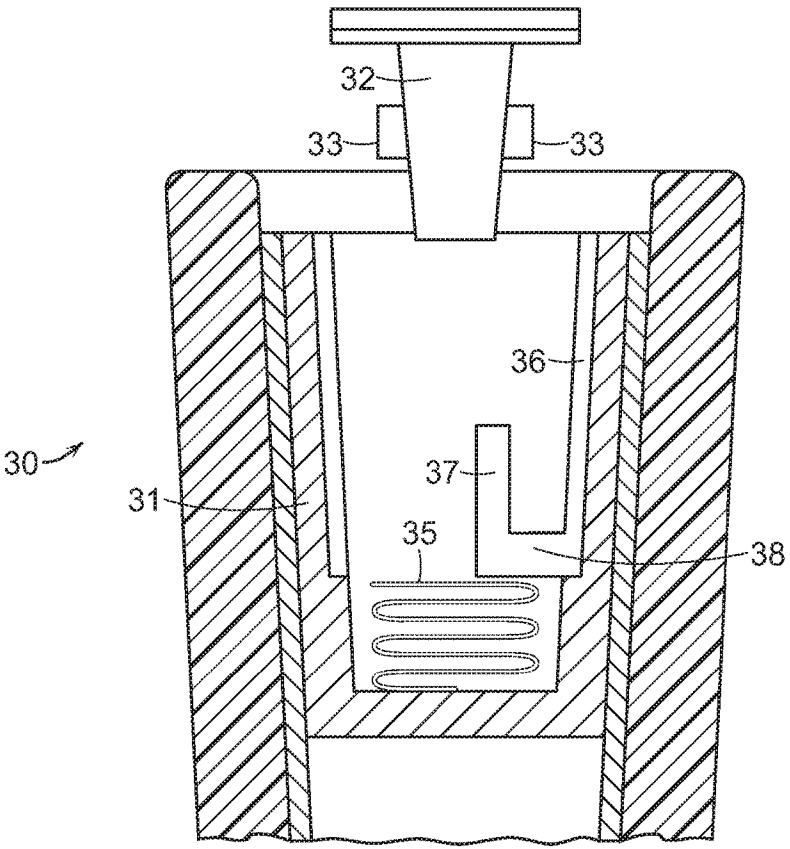
FIG. 3 is an exploded cross-sectional view of a weight system that may be incorporated in the golf club of FIG. 1.
Figure 2:
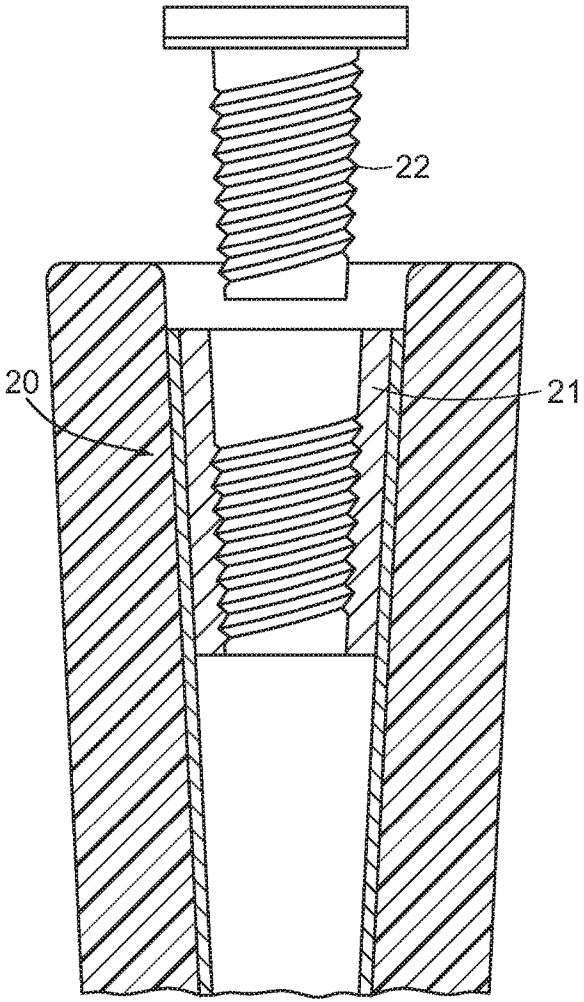
FIG. 2 is an exploded cross-sectional view of a weight system that may be incorporated in the golf club of FIG. 1.
Figure 4:
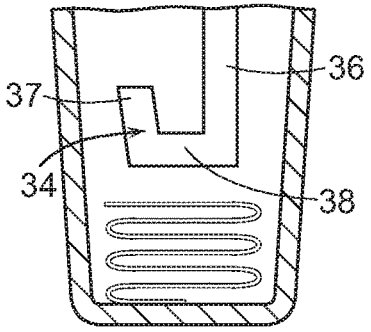
FIG. 4 is a cross-sectional view of a weight receptacle that may be incorporated in the golf club of FIG. 1.

Various weight attachments may be used in the system of the present invention. Referring to FIGS. 2-4 embodiments of weight attachments utilizing a fixed housing will be described. In the weight configuration of FIG. 2, a weight assembly 20 includes a weight housing 21 and a weight 22. The weight housing 21 is inserted into the shaft of the golf club and coupled therein to provide a support structure for the removable weight 22. Weight housing 21 is a generally tubular member that has an outer diameter that approximately matches the diameter of an inner bore of the shaft, and the outer surface of housing 21 may by cylindrical or conical to match the interior of the shaft. Weight housing 21 is coupled to the shaft preferably by adhesive so that it is fixed relative to the shaft. An interior bore of weight housing 21 is preferably threaded to threadably engage weight 22. As an example, the golf club head may also include a weight port having the same interior configuration that allows the weight 22 to be interchangeable between the golf club head and the shaft.

Referring to FIGS. 3 and 4, a weight assembly 30 includes a weight housing 31 that is coupled to the shaft and a weight 32 that is removably coupled to the housing. In the present embodiment, weight 32 couples to the housing 31 with a bayonet style connection that includes a spring loaded connection. The weight 32 includes tangs 33, or projections, that slide in slots 34. The slots 34 are generally shaped like a "J" to include a stem 36, a tail 37 and a return 38. A spring 35 is disposed in housing 31 that resists the insertion of weight 32 so that the spring pushes back against the weight as it is inserted and the tangs 33 are slid in the stems 36 of slots 34. The weight may then be rotated so that tangs 33 are slid through returns 38 and into tails 37 and the weight is allowed to partially retract under the force of the spring.

Figure 5:
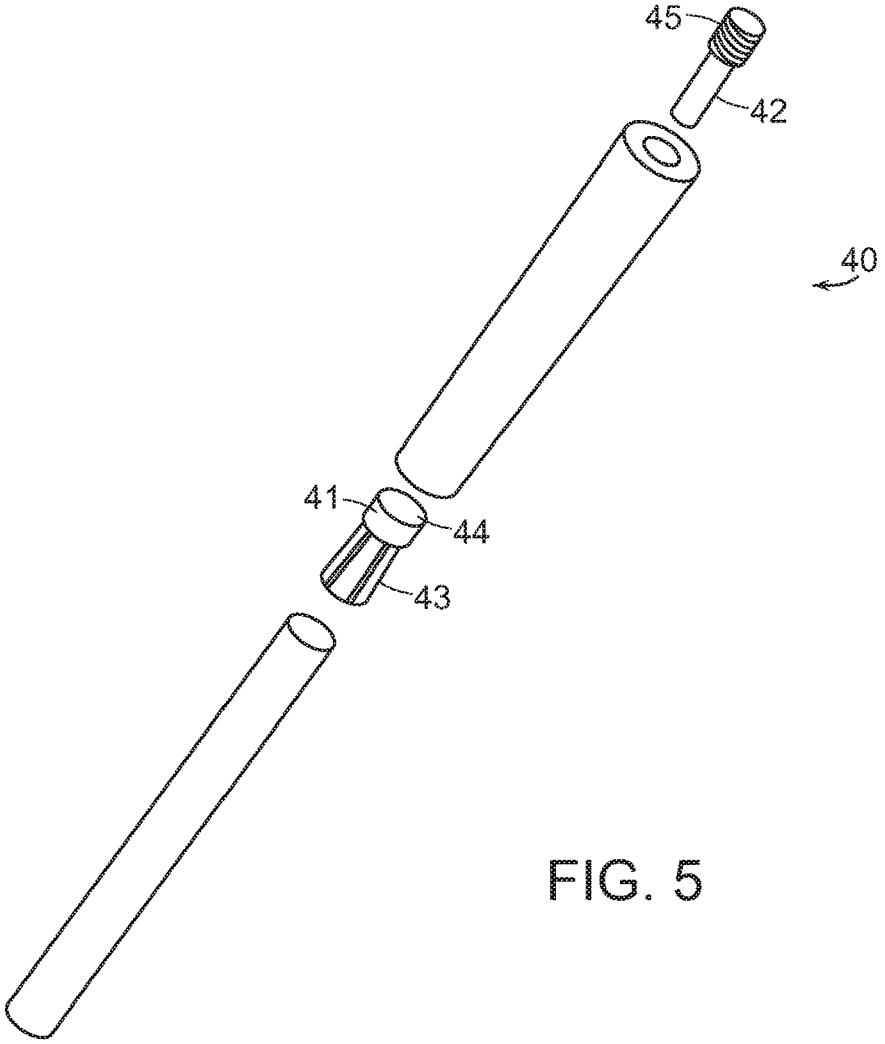
FIG. 5 is an exploded view of a weight system that may be incorporated in the golf club of FIG. 1.

In another embodiment, illustrated in FIG. 5, a weight assembly 40 includes a weight housing 41 and a weight 42. The weight housing 41 is inserted into the shaft of the golf club and coupled therein to provide a support structure for the removable weight 42. Weight housing 41 is a generally tubular member that has a first portion 43 having an outer diameter that is smaller than the diameter of an inner bore of the shaft, and a second portion 44 having an outer diameter that approximately matches an outer diameter of the shaft so that first portion 43 of housing is inserted into a proximal end of the shaft and the housing is covered by a grip. In the present embodiment, the second portion 44 includes a threaded internal bore. Weight housing 41 is coupled to the shaft preferably by adhesive so that it is fixed relative to the shaft. An interior bore of weight housing 41 is preferably threaded to threadably engage a threaded portion 45 of weight 42. As an example, the golf club head may also include a weight port that allows the weight 42 to be interchangeable between the golf club head and the shaft. In the present embodiment, the housing 41 includes a plurality of flexible cantilevered arms that assure intimate contact between the inner surface of the shaft and an outer surface of housing 41.

Figure 6:
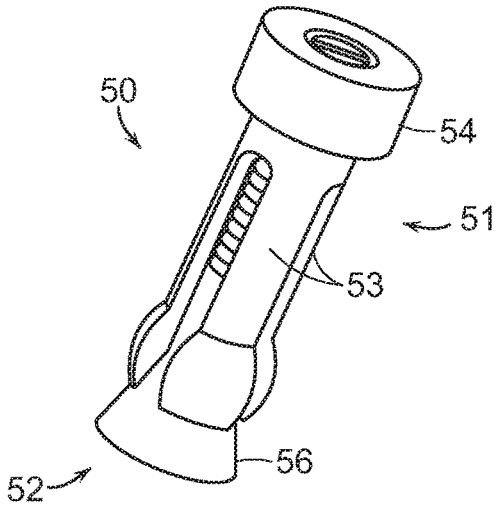
FIG. 6 is a perspective view of a weight that may be incorporated in the golf club of FIG. 1.
Figure 7:
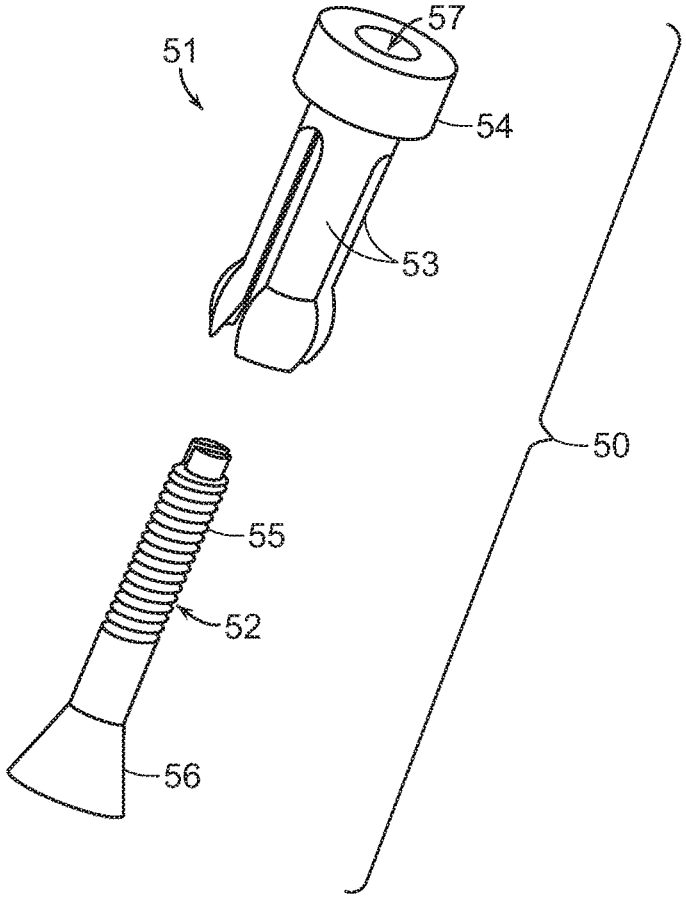
FIG. 7 is an exploded view of the weight of FIG. 6.

In other embodiments, the entire weight assembly may be removable and is constructed to provide an adjustable friction engagement with the inner wall of the shaft. For example, weight assembly 50 includes a housing 51 and an expansion member 52, as shown in FIGS. 6 and 7. Housing 51 includes a plurality of flexible cantilevered arms 53 extending from a body member 54. Housing 51 receives expansion member 52 so that expansion member is movable relative to housing 51. Expansion member 52 includes a shank portion 55 and a conical portion 56. Shank portion 55 includes a threaded surface that engages a threaded bore 57 in body member 54. Expansion member 52 is coupled to housing so that as it is moved relative to housing 51, conical portion 56 engages flexible arms 53 and causes the flexible arms to move laterally. As a result, as expansion member is moved relative to housing 51, the flexible arms 53 may be expanded to lock weight assembly 50 into the shaft.

Figure 8:
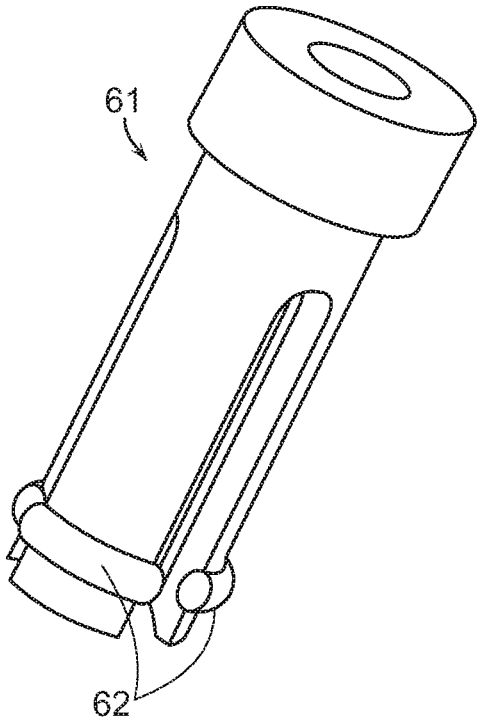
FIG. 8 is a perspective view of a weight that may be incorporated in the golf club of FIG. 1.
Figure 9:
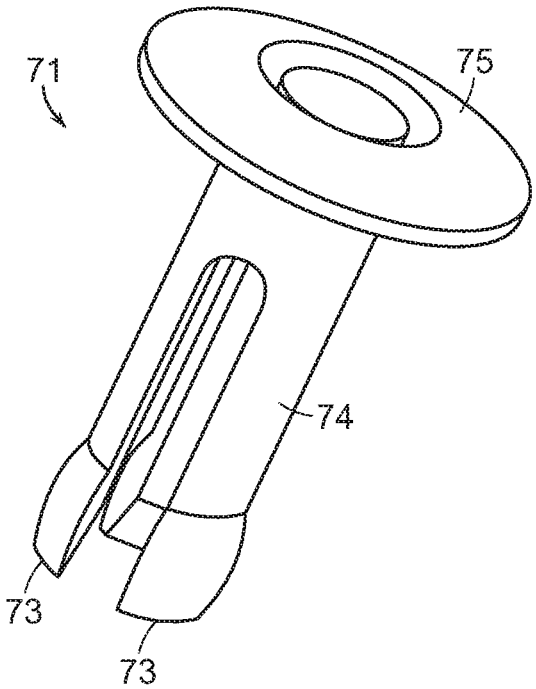
FIG. 9 is a perspective view of a weight that may be incorporated in the golf club of FIG. 1.

Alternative housing constructions to the weight assembly shown in FIGS. 6 and 7 will now be discussed. An alternative construction of a weight assembly housing is shown in FIG. 8. Housing 61 includes cushions 62 constructed from a soft, low durometer material, such as Shore A 60 or softer, on an outer surface of at least a portion of the flexible arms to provide a cushion to the inner surface of the shaft when the weight assembly is installed. A further example is shown in FIG. 9, in which a housing 71 includes a plurality of flexible cantileverd arms 73 and a body member 74 that includes a cap portion 75. Cap portion 75 locates the weight assembly when it is installed in a shaft but limiting the distance that the weight assembly can be inserted into the shaft by abutting a proximal end of the shaft or the proximal end of a grip installed on the shaft. Cap portion 75, and the cap portions illustrated in other illustrated embodiments, generally extend radially outward from an outer surface of the body member 74 and the flexible arms 73 by at least ⅛ inch. It should be appreciated that only the features differing from housing 51 are specifically described and that the remaining features of housings 61 and 71 are the same as those for housing 51, such as the threaded engagement between the housing and an expansion member and the housing's flexible arms.

Figure 10:
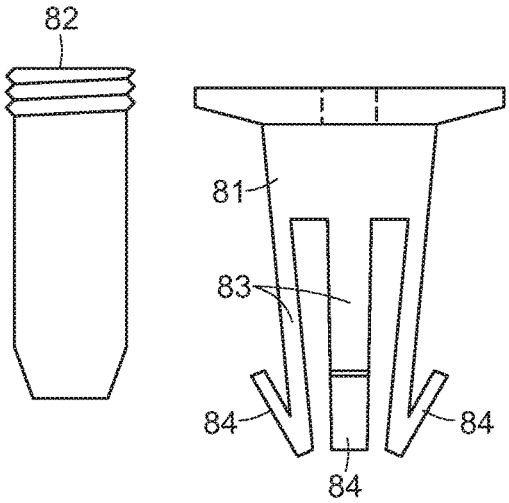
FIG. 10 is a side view of a weight system that may be incorporated in the golf club of FIG. 1.
Figure 11:
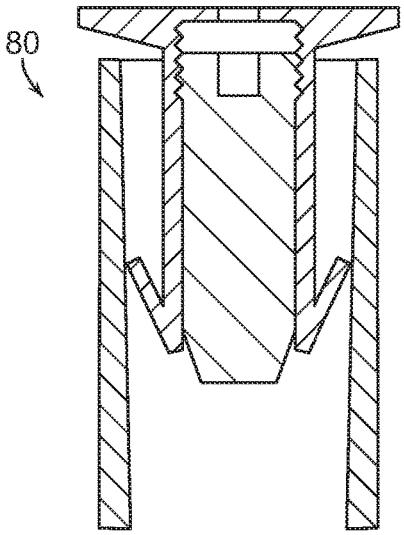
FIG. 11 is a cross-sectional view of the weight system of FIG. 10, in a grip portion of the golf club head, that may be incorporated in the golf club of FIG. 1.

Referring now to FIGS. 10 and 11, another weight assembly that provides a friction engagement with a shaft and that does not require an adhesive or other attachment mechanism will be described. In particular, a weight assembly 80 includes a housing 81 that receives a weight screw 82. Housing 81 includes a plurality of flexible cantilevered arms 83 and each flexible arm includes a flexible extension 84, that forms a cushion, both of which are able to flex radially from and toward the weight screw 82 so that they are forced radially inward when weight assembly 80 is inserted into a shaft. As a result, a radial force is placed on the inner wall of the shaft creating a friction fit so the weight assembly 80 is held in place.

Figure 12:
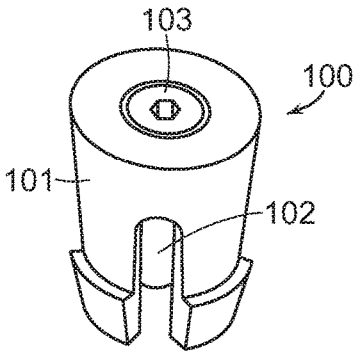
FIG. 12 is a perspective view of a weight system that may be incorporated in the golf club of FIG. 1.
Figure 13:
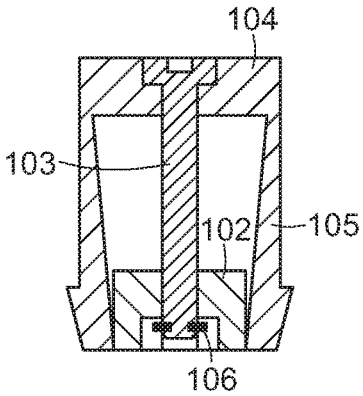
FIG. 13 is a cross-sectional view of the weight system of FIG. 12 in a first configuration.
Figure 14:
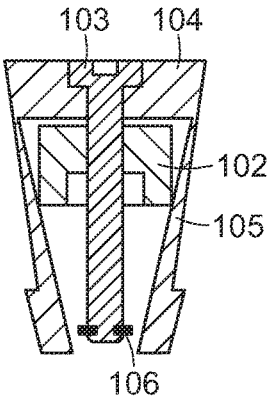
FIG. 14 is a cross-sectional view of the weight system of FIG. 12 in a second configuration.

In another embodiment, shown in FIGS. 12-14, a weight assembly 100 includes a housing 101, a weight member 102 and an actuator 103. Housing 101 includes a base 104 and a plurality of flexible cantilevered arms 105. Actuator 103 extends through base 104 and is coupled to weight member 102 so that weight member 102 is able to move relative to the actuator along the longitudinal axis of the actuator. As an example, actuator 103 may be a threaded fastener that engages a threaded bore in weight member 102, and weight member interacts with housing 101 so that it is restricted from rotating relative to housing 101. As a result, rotating actuator 103 relative to housing 101 causes the weight member 102 to be actuated by the threaded engagement and to translate. Actuator 103 and weight member 102 extend into an interior space defined by flexible arms 105. The interior space defined by flexible arms 105 is preferably tapered so that as weight member 102 moves along actuator 103 sliding abutment between weight member 102 and flexible arms 105 causes at least a portion of flexible arms 105 to move radially outward, as shown in FIGS. 13 and 14. When weight assembly 100 is inserted into a golf club shaft, or a weight port, that radial movement outward causes flexible arms to press on an interior surface of the shaft, or weight port, creating a frictional force that retains weight assembly 100 in the shaft.

A weight retainer 106 may be included to limit the travel of weight member 102 on actuator 103. In the present embodiment, weight retainer 106 is a snap ring that is disposed in a circumferential groove included on a distal portion of actuator 103. The retainer is located distal of the threaded bore of weight member 102 and prevents weight member 102 from fully disengaging from actuator 103.

Additionally, an actuator retainer 107 may be included so that actuator 103 is rotatably coupled to base 104. In particular, retainer 107 may be a snap ring that extends across the interface between a head of actuator 103 and base 104 so that actuator can rotate relative to the housing 101, but can not translate relative to the housing 101. As an alternative, a cap may be coupled to base 104 that captures actuator 103 while allowing access to a tool receiving feature in actuator 103.

Figure 17:
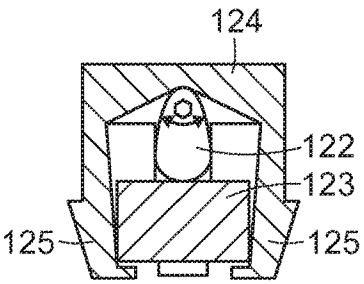
FIG. 17 is a cross-sectional view of the weight system of FIG. 16.
Figure 15:
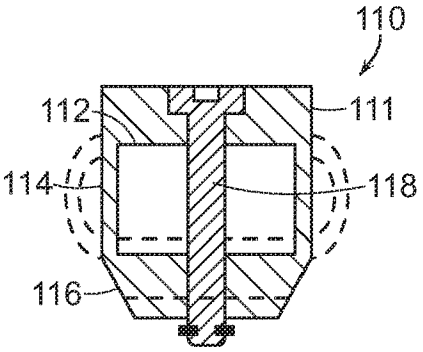
FIG. 15 is a cross-sectional view of another embodiment of a weight system.
Figure 16:
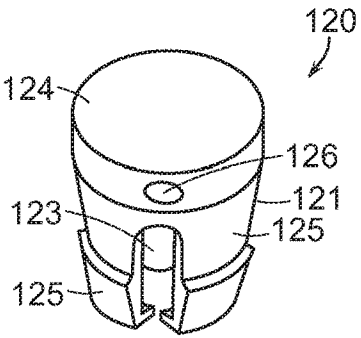
FIG. 16 is a perspective view of a weight system.

Additional embodiments of expanding weight member are illustrated in FIGS. 15-17. Referring first to FIG. 15, a weight assembly 110 includes a body 111 that includes a cap portion 112, a flexible portion 114, a base portion 116 and an actuator 118. In the present embodiment, actuator 118 is a threaded fastener that extends through cap portion 112 and flexible portion 114 and is threadably coupled to base portion 116. The actuator 118 and the body of the weight member are coupled so that relative movement of actuator 118 relative to the body causes the cap portion 112 to translate relative to base portion 116 and that relative translation causes the outer dimension, such as an outer diameter, of flexible portion 114 to change. For example, as illustrated, actuator 118 extends through a bore in cap portion 112 and is threaded into a bore in base portion 116, so that as actuator 118 is rotated relative to the body 111, the base portion 116 and cap portion 112 are drawn toward each other. As cap portion 112 and base portion 116 are drawn toward each other, the walls that form flexible portion 114 flex outward to increase the outer diameter of the body 111 and to contact an inner wall of a shaft of a golf club to hold weight assembly 110 in place.

In another expanding weight member embodiment, a cam mechanism is utilized to operate a weight member as shown in FIGS. 16 and 17. In particular, a weight assembly 120 includes a body 121, a cam 122 and a moveable member 123. Body 121 includes a base portion 124 and a plurality of flexible cantilevered arms 125 that define an interior cavity. Cam 122 and moveable member 123 are disposed in the interior cavity. Cam 122 is rotatably coupled to base portion 124 and moveable member abuts cam 122 and translates within the interior cavity so that it is moveable toward/away from the base portion 124 under the influence of cam 122. At least distal portion of the interior cavity distal of base portion 124 tapers so that the inner dimension of the interior cavity is smaller than an outer dimension of moveable member 123 so that translation of moveable member 123 distally forces flexible arms 125 to move radially outward. When in use, the radial movement of flexible arms 125 places a force on an interior of a golf club shaft of and holds weight assembly 120 in place.

Weight assembly 120 is actuated by the interaction between cam 122 and moveable member 123. In particular, the translation of moveable member 123 away from base portion 124 causes body 121 to expand by flexing flexible arms 125 outward. Cam 122 is rotatably coupled to base portion 124 and is accessible through an access port 126 included in base portion 124, so that cam 122 may be manually rotated relative to body 121 using a tool. The rotation of cam 122 and the abutment of cam 122 with moveable member 123 causes moveable member 123 to translate and to expand body 121.

Figure 18:
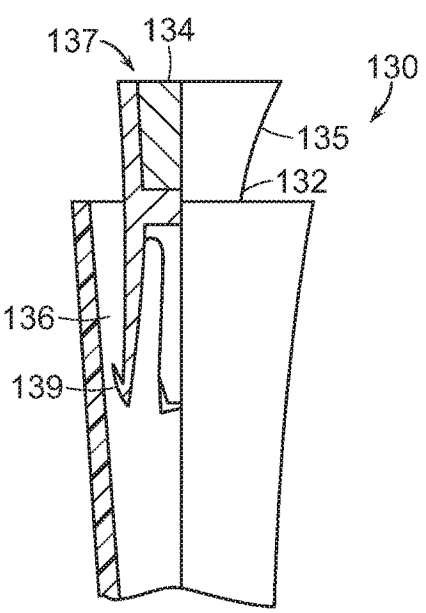
FIG. 18 is a partial cross-sectional view of a weight system.
Figure 19:
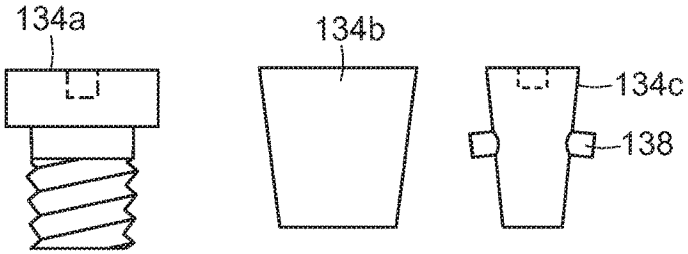
FIG. 19 illustrates alternative weight members that may be included in the weight assembly of FIG. 18.

In additional embodiments, a weight assembly includes a housing that is mounted in a golf club shaft, and a weight member that is coupled to the housing. In an embodiment, a weight assembly 130 includes a housing 132 and a weight member 134, and is shown in FIGS. 18 and 19. Housing 132 includes a proximal weight receiving portion 135 and a distal flexible portion 136. Weight receiving portion 135 defines a weight receptacle 137 that includes a connection mechanism that complements a connection mechanism included on the desired weight member. Flexible housing portion 136 is coupled to proximal weight receiving housing portion 135 and includes a plurality of flexible cantilevered arms that are able to conform to the interior shape of the golf club shaft. Each of the flexible arms includes a barb 139 disposed at a distal end that extends outward from the adjacent portion of the flexible arm. Preferably, the flexible arms bend to match the interior shape of the golf club shaft, and housing 132 is coupled to the interior of the shaft, such as by an adhesive.

The connection mechanism included in housing 132 and on the weight member 134 is preferably configured so that the weight member can be selectively coupled to the housing. For example, the weight member and weight receptacle 137 may be threaded, as shown by weight member 134*a*. As an alternative, the weight member and weight receptacle may include a bayonet style of fastener that includes a spring load and projections 138 on the weight member 134*c* that are received in a J-shaped slot in weight receptacle 137. As a still further alternative, the weight member and weight receptacle 137 may be configured to have a magnetic attachment as shown by weight member 134*b*.

Figure 20:
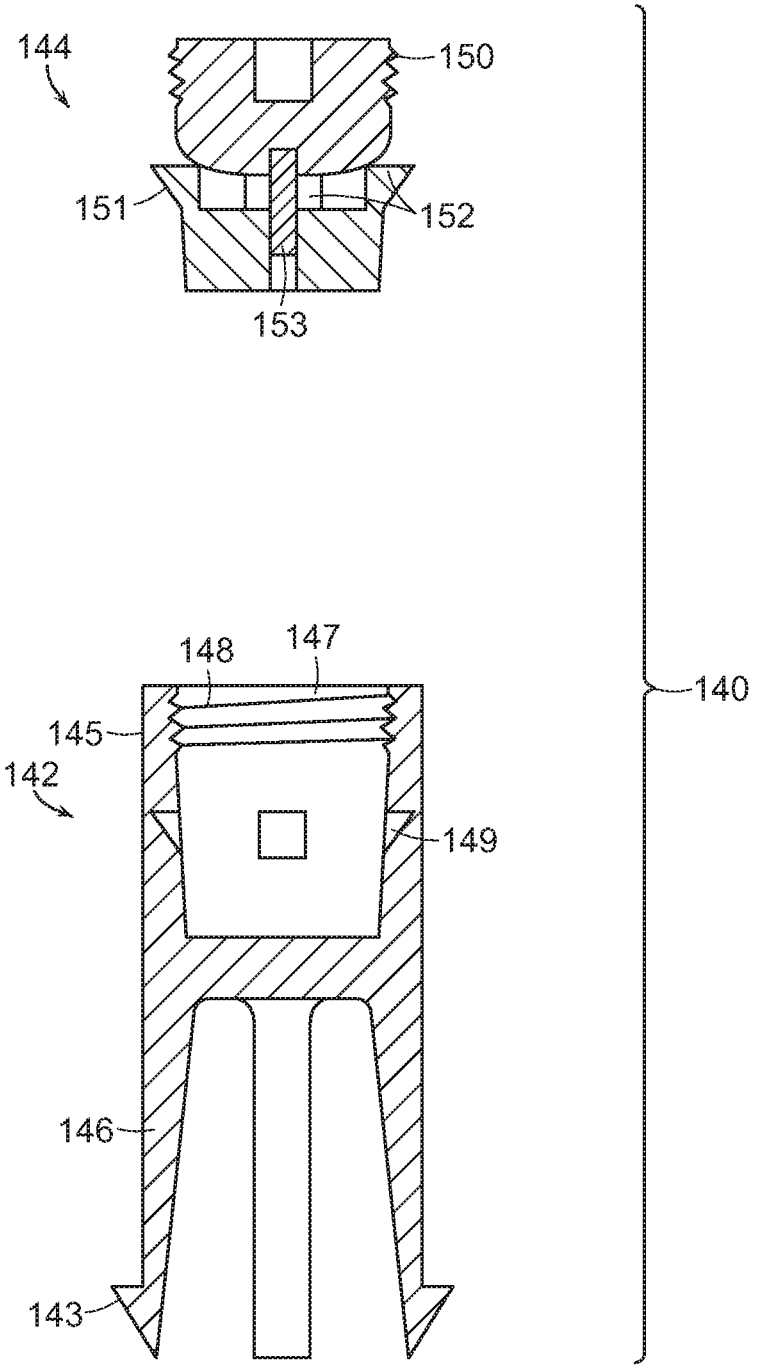
FIG. 20 is a cross-sectional exploded view of an alternative construction of a weight system similar to the weight assembly of FIG. 18.

In another embodiment, shown in FIG. 20, a weight assembly includes a housing 142 mounted in a golf club shaft and a weight member 144. Housing 142 includes a proximal weight receiving portion 145 and a distal flexible portion 146. Weight receiving portion 145 defines a weight receptacle 147 that includes a connection mechanism, such as a threaded portion 148, that couples with a connection mechanism, such as threaded portion 150, included on weight member 144. Flexible housing portion 146 is coupled to proximal weight receiving housing portion 145 and includes a plurality of flexible cantilevered arms that are able to conform to the interior shape of the golf club shaft and each of the flexible arms includes a barb 143 at a distal end that extends outward from an outer surface of an adjacent portion of the flexible arm. Preferably, the flexible arms bend to match the interior shape of the golf club shaft and housing 142 is coupled to the interior of the shaft, such as by an adhesive.

In the present embodiment, the connection mechanism between housing 142 and weight member 144 includes threaded portions in each of the housing and the weight member, an undercut portion 149 in the housing and an expansion portion 151 in the weight member. The threaded portion 148 in housing 142 is coupled to the threaded portion 150 of weight member 144. Expansion portion 151 includes a plurality of flexible cantilevered arms 152. As the weight member is threaded into the housing, the expansion portion 151 of weight member 144 engages the undercut portion 149 of housing 142. As the weight member further engages the housing the threaded portion 150 abuts the expansion portion 151 and applies a radial force to the flexible arms 152, thereby preventing the expansion portion 151 from disengaging the undercut portion 149 of housing 142. Weight member 144 also includes an alignment member 153 that maintains threaded portion 150 centered relative to expansion portion 151 during installation and removal.

Figure 21:
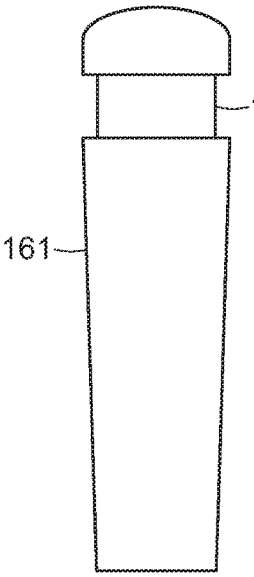
FIG. 21 is a side view of a grip that receives an alternative weight construction of the present invention.
Figure 22:
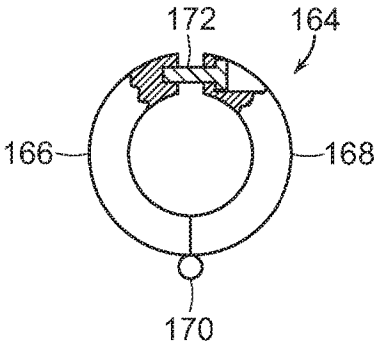
FIG. 22 is a top view of a weight member that may be used with the grip of FIG. 21.

In additional embodiments, a weight system includes a weight member that is configured to couple to a feature included in a grip of a golf club. In a first embodiment, shown in FIGS. 21 and 22, a grip 160 includes an elongate grip body 161 and a circumferential channel 162 that extends into the grip body 161 to form an annular slot in an outer surface of grip 160 so that it is open outwardly. A weight member 164 includes a first body 166 and a second body 168 and the two bodies are coupled by a hinge member 170. The first body 166 and second body 168 are each formed as a partial annulus and the hinged connection allows the bodies to be rotated relative to each other to open the annulus so that it may be wrapped around the grip in the circumferential channel 162 and coupled thereto. The weight member also includes a fastener 172 that interacts with the ends of the first body 166 and second body 168 opposite the hinge 170 to couple the ends of the bodies when the weight member is in a closed configuration. Fastener 172 is preferably a mechanical fastener such as one or more threaded fasteners.

Figure 23:
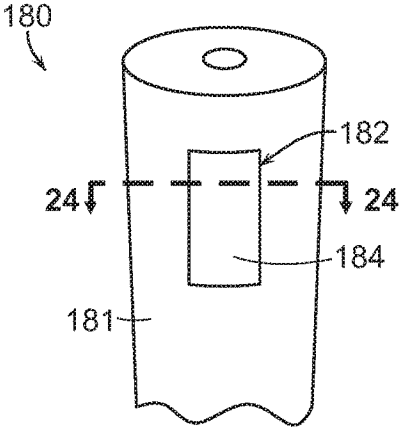
FIG. 23 is a side view of a weight system including an alternative weight construction mounted in a grip.
Figure 24:
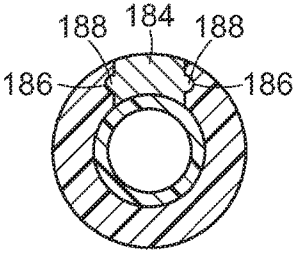
FIG. 24 is a cross-sectional view, taken along line 23-23 of the weight system of FIG. 23.

In another embodiment, illustrated in FIGS. 23 and 24, a grip includes a recess that receives a weight member and retains the weight member. In particular, a grip 180 includes an elongate body 181 that defines a weight receiving recess 182 that is open outwardly. Recess 182 extends into the body 181 from an outer surface of the body and is shaped to complement the shape of a weight member 184. Additionally, recess 182 includes channels 186 that receive projections 188 included on weight member 184. In particular, the material of the elongate body 181 of grip is flexible and as weight member 184 is pressed into recess 182 the material on the edges of recess 182 elastically deforms to allow the projections 188 to become seated in channels 186.

Figure 25:
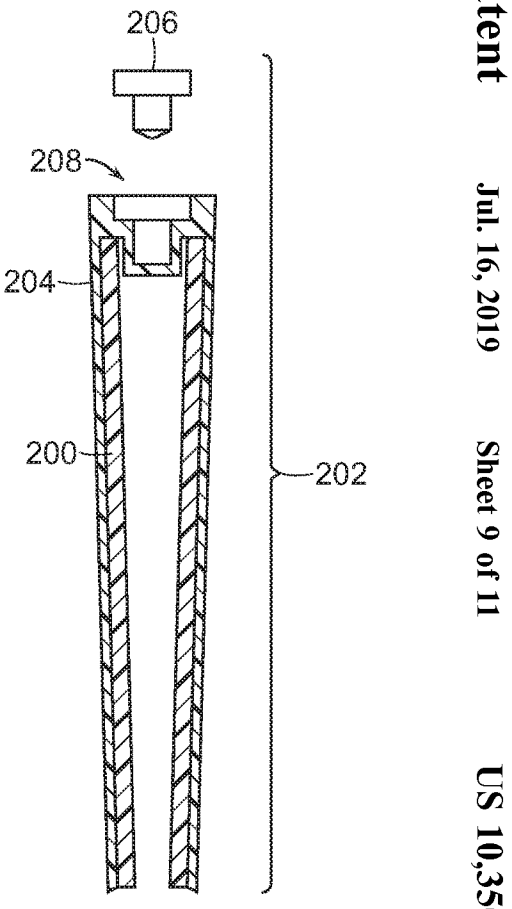
FIG. 25 is a cross-sectional view of a grip portion of a golf club head.

In another embodiment, shown in FIG. 25, a portion of a golf club including a grip may include a structure configured to receive a weight. In particular, a golf club includes a shaft 200 and a weighted grip system 202 that is mounted on a proximal end of the shaft. Grip system 202 generally includes a grip member 204 that provides a gripping surface for a user of the golf club head, and a weight member 206 that mounts in a proximal portion of the grip member 204. In the illustrated system grip member 204 includes a recessed stall, such as mount 208, on a proximal, butt end of the grip that can house one of a plurality of weight members 206. Preferably, the mount 208 is configured similar to a mount disposed on a golf club head so that weight member 206 may be interchangeably coupled on the golf club head and in the grip member 204.

A plurality of weight members 206 having different masses may be provided so that a desired amount of grip weighting may be incorporated into the golf club and that weighting may be utilized for counterweighting and/or altering the overall mass and/or swingweight of the golf club. The weight members 206 may be constructed from one or more materials, such as metallic or non-metallic materials, so that a weight member 206 having a desired mass may be constructed. Examples of materials suitable for the construction of weight members 206 include steel, aluminum, tungsten, titanium, rubber and plastic. The golf grip may have a core size ranging generally between about 0.58 inch and about 0.64 inch. Additionally the diameter of weight member 206 may be between about 0.1 inch and about 1.0 inch, the depth of weight member 206 may be between about 0.1 inch and about 10.0 inch, and the mass of the weight member 206 is preferably between about 1 g and about 1 kg.

Figure 26:
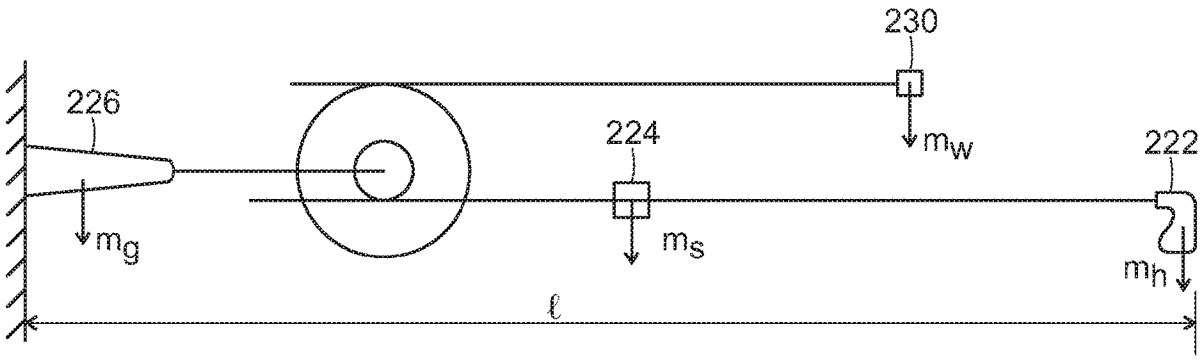
FIG. 26 is a schematic view of a weight adjustment mechanism for a golf club in accordance with the present invention.
Figure 27:
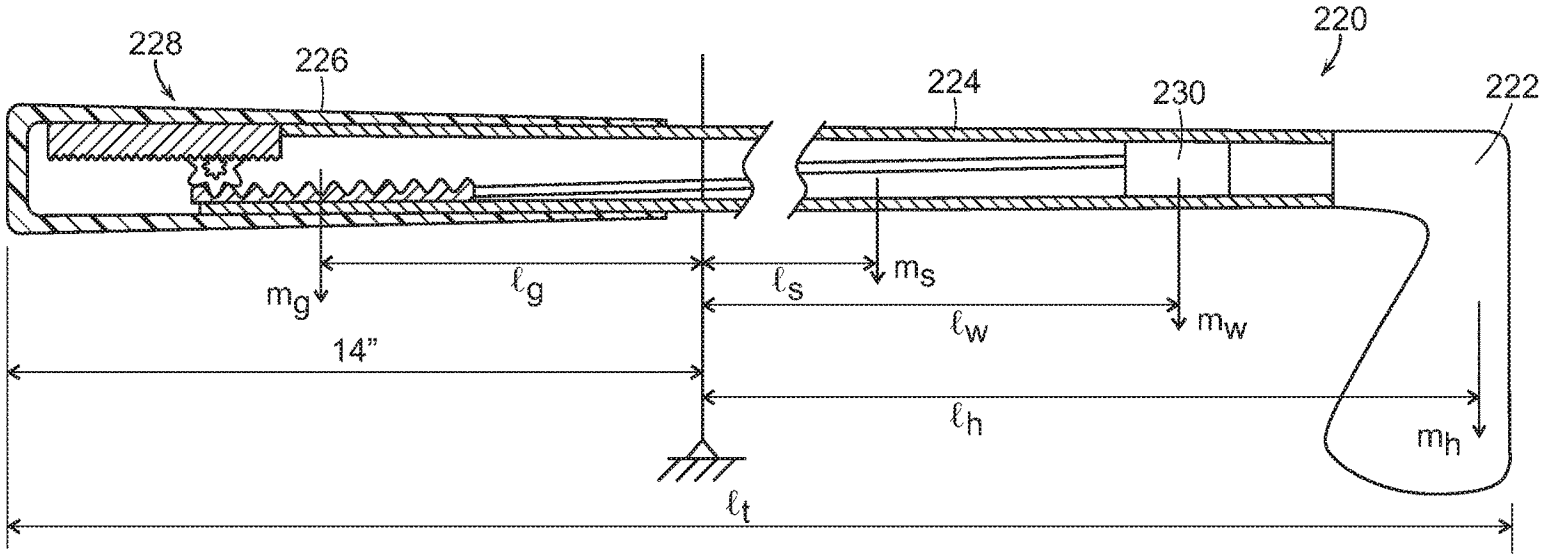
FIG. 27 is a cross sectional view of an embodiment of a golf club including a weight adjustment mechanism.

In another embodiment of an overall golf club weighting system, an automatic swing weight compensation device permits the length of the golf club to be adjusted while the system automatically adjusts the weighting so that the swingweight remains constant. As illustrated in FIGS. 26 and 27, the golf club 220 includes a golf club head 222 coupled to a distal end of a shaft 224, a grip 226 coupled to a proximal end of the shaft 224, and a mass compensating mechanism. The mass compensating mechanism generally includes an actuator 228 and a mass member 230.

Swingweight is determined by calculating the moment produced by all of the golf club components about a point on the golf club defined as the fulcrum which is located at 14 inches from the proximal end of the golf club, which generally corresponds to the butt end of the golf club grip. Because the fulcrum is located by measuring from the proximal end of the golf club a distance of 14", and because golf clubs generally have grips, the contribution to swingweight of the grip remains constant in a golf club having adjustable length. However, in a club having adjustable length, the change in length results in the positions of the center of gravity of the shaft and the center of gravity of the golf club head altering the swingweight. In particular, as the length of the golf club is increased, the contributions of the shaft and golf club head increase the swingweight. The actuator and mass member are configured to counteract the increased contribution of the shaft and head by reducing the contribution of the mass member. The contribution of the mass member is reduced by moving the mass member closer to the proximal end of the golf club so that the distance between the center of gravity of the weight member and the fulcrum is reduced. The amount of change in the contribution to swingweight of the shaft and head caused by the change in length must be equally counteracted by the change in contribution to swingweight of the mass member to maintain a constant swing weight, however, it should be appreciated that the system may alternatively be configured to reduce the impact on swingweight by counteracting a portion of the change in swingweight caused by the length change. For example, to maintain a constant swing weight the relationship $\Delta l_w \cdot m_w = (m_s + m_h) \cdot \Delta l_T$ must be maintained.

A described above, the actuator 228 is constructed to alter the relationship of the weight member relative to the fulcrum to compensate for the change in golf club length. For example, the actuator may be constructed as a mechanical, electromechanical and/or pneumatic system. A first mechanical example is illustrated in FIG. 27 which utilizes the geared interaction of a rack and pinion, or a plurality of racks and pinions, to alter the mass member location.

Figure 28:
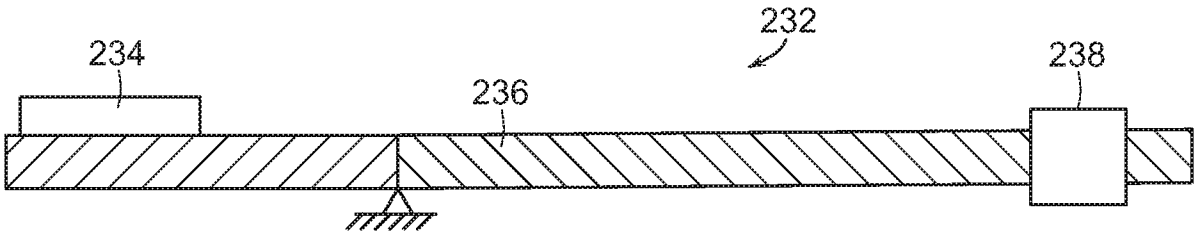
FIG. 28 is a schematic illustration of an embodiment of a weight adjustment mechanism.

In another example, as shown schematically in FIG. 28, a lead screw is utilized as an actuator so that rotation of the lead screw alters the location of the mass member. In particular, the actuator 232 includes a grip member 234, a lead screw 236 and a mass member 238. The grip member 234 is coupled to a grip and causes the lead screw to turn when the length of a golf club including actuator 232 is altered. As shown schematically, lead screw 236 may include opposing threads so that the grip and mass member are driven in opposite directions. Alternatively, the threaded portion may be configured in the same direction so that the grip and the mass member move in the same direction. Furthermore, the pitch of the threaded portions may be the same or different so that the amount of movement of the grip is either the same or different than the mass member.

Figure 29:
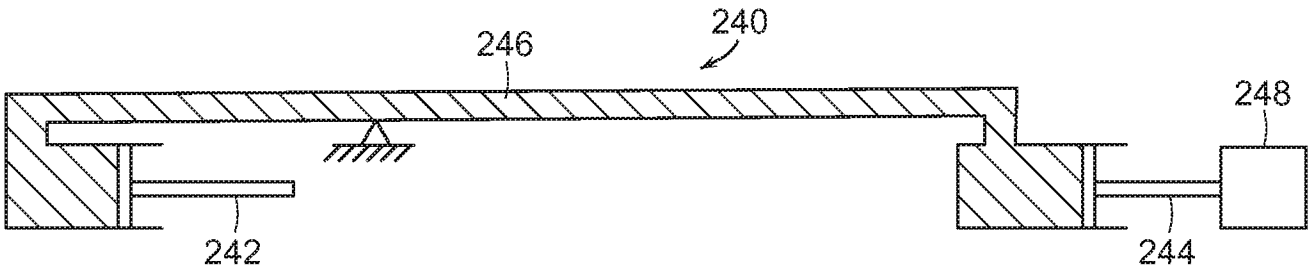
FIG. 29 is a schematic illustration of an embodiment of a weight adjustment mechanism.

In a still further embodiment, illustrated schematically in FIG. 29, a pneumatic system is utilized to alter the location of the mass member. Actuator 240 includes a grip piston 242, a mass piston 244, and a conduit 246 that provides fluid communication between the pistons, which may be a liquid or gas. The grip piston 242 is coupled to a grip of the golf club, and the mass piston is coupled to a mass member 248 of the golf club. The sizes of pistons and the chambers that house the pistons may be altered to alter the relative amount of movement between the pistons when they are actuated. Furthermore, the direction of the pistons may be selected to select the desired direction of movement. It should be appreciated that each of the actuators described herein may be configured to create the same or different relative motion between the grip and mass member with regard to direction and distance. Additionally, the actuator may be configured to place the mass member anywhere in the golf club including on either side of the fulcrum.

Although the inventive weight is illustrated in a wood-type golf club, it should be appreciated that the weight may be incorporated in any type of golf club. For example, the inventive weight may be included in drivers, fairway woods, utility clubs, hybrids, iron-type golf clubs, wedges and putters.

While it is apparent that the illustrative embodiments of the invention disclosed herein fulfill the objectives stated above, it is appreciated that numerous modifications and other embodiments may be devised by those skilled in the art. Elements from one embodiment can be incorporated into other embodiments. Therefore, it will be understood that the appended claims are intended to cover all such modifications and embodiments, which would come within the spirit and scope of the present invention.

We claim:

1. A weight assembly for attachment to a golf club, comprising a housing, wherein the housing includes a base and a plurality of flexible cantilevered arms extending distally away from the base;

a weight member disposed in the housing slidably abutting the plurality of flexible cantilevered arms, wherein the weight member has a first position relative to the housing and a second position relative to the housing; and an actuator interposed between a portion of the housing and a portion of the weight member, wherein the actuator is movably coupled to the housing and movably coupled to the weight member, wherein when the weight member is in the first position the flexible cantilevered arms are in a retracted configuration, and wherein when the weight member is in the second position the flexible cantilevered arms are in an expanded configuration wherein a maximum outer dimension of the flexible cantilevered arms is greater in the expanded configuration than in the retracted configuration.

2. The weight assembly of claim 1, wherein the base includes an aperture that extends entirely through the base.

3. The weight assembly of claim 2, wherein the actuator is a threaded fastener that extends through the base and into a threaded bore included in the weight member.

4. The weight assembly of claim 3, further comprising a weight retainer, wherein the retainer couples to a distal end of the threaded fastener and extends radially outward from an outer surface of the threaded fastener.

5. The weight assembly of claim 3, wherein the weight member is configured to interact with the flexible cantilevered arms of the housing to prevent relative rotation between the weight member and the housing.

6. The weight assembly of claim 3, wherein the threaded fastener includes a head that is recessed into the base of the housing, wherein a snap ring extends across an interface between a side wall of the head and the housing, wherein the snap ring prevents the head translating relative to the housing.

7. The weight assembly of claim 3, further comprising a cap coupled to the base, wherein the threaded fastener includes a head that is recessed into the base of the housing and the cap captures the head in the base.

8. The weight assembly of claim 1, wherein the flexible cantilevered arms define an interior space, wherein the interior space is tapered so that it is narrower further away from the base, wherein the weight member is disposed within the interior space.

9. The weight assembly of claim 1, wherein at least one of the flexible cantilevered arms includes a cushion disposed on an outer surface of the flexible cantilevered arm, wherein the cushion is a flexible extension of the flexible cantilevered arm.

10. A weight assembly for attachment to a golf club, comprising a housing, wherein the housing includes a base and a plurality of flexible cantilevered arms extending distally away from the base, wherein at least one of the flexible cantilevered arms includes a cushion disposed on an outer surface of the flexible cantilevered arm;

a weight member disposed in the housing slidably abutting the plurality of flexible cantilevered arms, wherein the weight member has a first position relative to the housing and a second position relative to the housing; and an actuator interposed between a portion of the housing and a portion of the weight member, wherein the actuator is movably coupled to the housing and movably coupled to the weight member, wherein when the weight member is in the first position the flexible cantilevered arms are in a retracted configuration, wherein when the weight member is in the second position the flexible cantilevered arms are in an expanded configuration, and wherein a maximum outer dimension of the flexible cantilevered arms is greater in the expanded configuration than in the retracted configuration.

11. The weight assembly of claim 10, wherein the base includes an aperture that extends entirely through the base.

12. The weight assembly of claim 11, wherein the actuator is a threaded fastener that extends through the base and into a threaded bore included in the weight member.

13. The weight assembly of claim 12, further comprising a weight retainer, wherein the retainer couples to a distal end of the threaded fastener and extends radially outward from an outer surface of the threaded fastener.

14. The weight assembly of claim 12, wherein the weight member is configured to interact with the flexible cantilevered arms of the housing to prevent relative rotation between the weight member and the housing.

15. The weight assembly of claim 12, wherein the threaded fastener includes a head that is recessed into the base of the housing, wherein a snap ring extends across an interface between a side wall of the head and the housing, wherein the snap ring prevents the head translating relative to the housing.

16. The weight assembly of claim 12, further comprising a cap coupled to the base, wherein the threaded fastener includes a head that is recessed into the base of the housing and the cap captures the head in the recess.

17. The weight assembly of claim 10, wherein the actuator includes a cam that abuts the weight member, wherein the cam is rotatably coupled to the housing so that it can be rotated into a first position and into a second position, wherein in the first position the cam spaces weight member from the base a first distance, and wherein in the second position the cam spaces weight member from the base a second distance that is greater than the first distance.

18. The weight assembly of claim 10, wherein the cushion is constructed from a soft material having a hardness no harder than Shore A 60.

19. A weight assembly for attachment to a golf club, comprising a housing, wherein the housing includes a base and a plurality of flexible cantilevered arms extending distally away from the base;

a weight member disposed in the housing slidably abutting the plurality of flexible cantilevered arms, wherein the weight member has a first position relative to the housing and a second position relative to the housing; and an actuator interposed between a portion of the housing and a portion of the weight member, wherein the actuator is movably coupled to the housing and movably coupled to the weight member, wherein the actuator includes a cam that abuts the weight member, wherein the cam is rotatably coupled to the housing so that it can be rotated into a first position and into a second position, wherein in the first position the cam spaces weight member from the base a first distance, and wherein in the second position the cam spaces weight member from the base a second distance that is greater than the first distance, and wherein when the weight member is in the first position the flexible cantilevered arms are in a retracted configuration, and wherein when the weight member is in the second position the flexible cantilevered arms are in an expanded configuration wherein a maximum outer dimension of the flexible cantilevered arms is greater in the expanded configuration than in the retracted configuration.

20. The weight assembly of claim 19, wherein at least one of the flexible cantilevered arms includes a cushion disposed on an outer surface of the flexible cantilevered arm, wherein the cushion is a flexible extension of the flexible cantilevered arm.

* * * * *